United States Patent [19]

Kocina et al.

[11] 4,216,597

[45] Aug. 12, 1980

[54] PICTURE FRAME RETAINING CLIP

[75] Inventors: Lawrence A. Kocina; John N. Roche, both of Greenville, Pa.

[73] Assignee: R. D. Werner Co., Inc., Greenville, Pa.

[21] Appl. No.: 26,656

[22] Filed: Apr. 3, 1979

[51] Int. Cl.[3] ..... G09F 1/12

[52] U.S. Cl. ..... 40/156; 40/152.1; 248/496

[58] Field of Search ..... 40/156, 152.1, 152, 40/155, 154, 617; 248/496, 497, 498, 544; 403/401, 402; 52/544

[56] References Cited

U.S. PATENT DOCUMENTS

| | | | |
|---|---|---|---|
| 1,959,745 | 5/1934 | Stout | 40/156 |
| 2,450,330 | 9/1948 | De Giers | 24/259 |
| 2,484,349 | 10/1949 | Kelly | 40/156 X |
| 2,581,843 | 1/1952 | Edwards | 40/155 |
| 2,639,109 | 5/1953 | Hoag | 248/497 |
| 2,651,129 | 9/1953 | Spertus | 40/152.1 |
| 3,031,159 | 4/1962 | Waller | 248/496 |
| 3,186,117 | 6/1965 | Detje | 40/152.1 |
| 3,541,714 | 11/1970 | Buck | 40/156 |
| 3,670,439 | 6/1972 | Shimizu | 40/156 |
| 3,924,307 | 12/1975 | Tate | 40/156 X |
| 3,965,601 | 6/1976 | Nielsen | 40/155 |
| 3,996,682 | 12/1976 | Schwartz | 40/156 |
| 4,041,632 | 8/1977 | Sarkisian | 40/156 |
| 4,063,378 | 12/1977 | Burke | 40/156 |

*Primary Examiner*—John F. Pitrelli

[57] ABSTRACT

A picture retaining clip for use at the corners and along the sides of a back-loading picture frame, which clip also may serve as a means for hanging the frame. The clip is a strip of resilient material with a central web and bent ends. When the clip is mounted at the corners of the frame, a tab at each end of the clip abuts a forwardly raised ridge at the rear of the frame. When the clip is mounted along the side of the frame, a flange formed along the central web of the clip abuts either a forwardly raised ridge at the rear of the frame or a rearwardly raised ridge along the front of the frame. A hole and serrations in the central web of the clip receive hooks, nails, wire, and the like for hanging the frame.

14 Claims, 10 Drawing Figures

PICTURE FRAME RETAINING CLIP

This invention relates to back-loading picture frames. In particular, it relates to means for retaining pictures in back-loading frames and to means for hanging such frames.

Back-loading picture frames are so called because the glass, picture, mat, etc. are all placed in the frame from its rear. The forward portion of the frame is smaller than the rear thereof, so that, while the picture, etc. are easily inserted into the rear of the frame, they abut the forward portion of the frame (The forward direction is the direction from which the contents of the frame are normally viewed). Mounting of the picture in the frame is completed by securing the picture frame from movement away from the forward portion of the frame. Tacks, brads, nails, and the like have been used to secure the picture in the frame. However, a number of clamps, clips, and the like, which do not penetrate the frame, have been developed for retaining pictures in back-loading frames.

Some devices used to retain pictures in back-loading frames are essentially clamps that grip the picture and the frame. Another form of retaining devices is a compressed spring clip which does not grip the picture and the frame but rather is compressed between the rear of the frame and the picture. Such compressed spring clips are generally better protected from loosening by jarring because they are generally less exposed than gripping clamps. Of these:

U.S. Pat. No. 2,450,330 (De Giers) discloses a fastening device for mounting glass plates. U.S. Pat. No. 2,484,349 (Kelly) discloses a fastening device for use in hanging leather hides. Both these devices are not used at corners, but only at predetermined positions along the sides.

U.S. Pat. Nos. 3,996,682 (Schwartz) and 3,670,439 (Shimizu) both disclose compressed spring clips for securing pictures in frames. These devices are used only at the corners of the frames.

U.S. Pat. Nos. 4,041,632 (Sarkistian), 3,965,601 (Nielson), and 2,651,129 (Spertus) also disclose compressed spring strips or clips for securing pictures in frames. These devices are used only along the sides of the frames and not at the corners. The clip in Patent No. 2,651,129 is especially formed for mounting in openings in sides of the frame.

Various means have been used for hanging picture frames. For example, U.S. Pat. No. 3,031,159 (Waller) discloses a bracket with recesses in a central elongate body for receiving nails which have been driven into the wall. There are devices for securing the frame backing and pictures in frames designed to be clamped over the frame. For example, U.S. Pat. No. 3,924,307 (Tate) discloses a gripping clamp with notches for engaging nails or hooks in a wall. U.S. Pat. Nos. 3,541,714 (Bruck) and 2,581,843 (Edwards) disclose clamps with holes for receiving nails, hooks, and the like.

Although compressed spring clips are a preferred means for retaining pictures in frames, it is often difficult to adapt them for use as hanging devices. When the compressed spring clips disclosed in the aforementioned patents are attached to back-loading frames, much of the clip structure is obscured from view even from the rear of the frame and access to them is severely hindered, thereby making it difficult to adapt them for receiving nails, hooks, wires, and the like. U.S. Pat. Nos. 3,186,117 (Detje) and 2,593,195 (Rosenberg) disclose retaining devices using compressed spring strips, but these strips are entirely obscured from access.

It is an object of the present invention to provide an improved removable means for retaining pictures and the like in back-loading frames.

Another object of the present invention is to provide an improved removable means for hanging a back-loading picture frame from a wall or the like.

A further object of the present invention is to provide a simple removable device which provides means both for retaining pictures and the like in back-loading frames and for hanging such frames.

Still another object of the present invention is to provide a clip for retaining pictures in back-loading frames which can be used both at the corners and along the sides of the frame.

Other objects of the invention and the invention itself will become more readily apparent to those skilled in the art to which the invention pertains from the appended description in which description reference is made to the accompanying drawings, in which.

The preferred embodiments of the invention comprise a clip for retaining a picture in a back-loading frame, which clip can also serve to help hang the frame. In its simplest forms, the clip is adapted for use as a retaining clip at the corners or along the sides of a back-loading picture frame. However, several features may be added to the basic clip. In one preferred embodiment, the clip has all these additional features and, therefore, has several uses.

Figure 1:
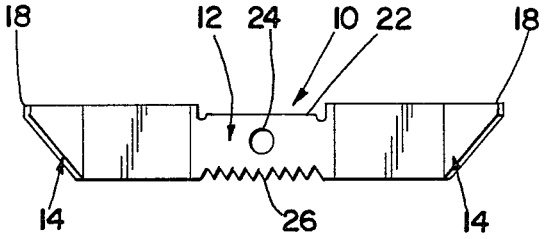
FIG. 1 is a top plan view of the preferred form of a clip according to the invention.
Figure 2:
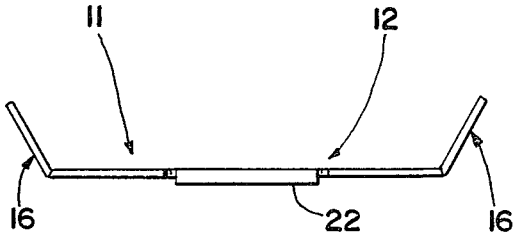
FIG. 2 is a side elevational view of an alternate form of a clip according to the invention.
Figure 4:
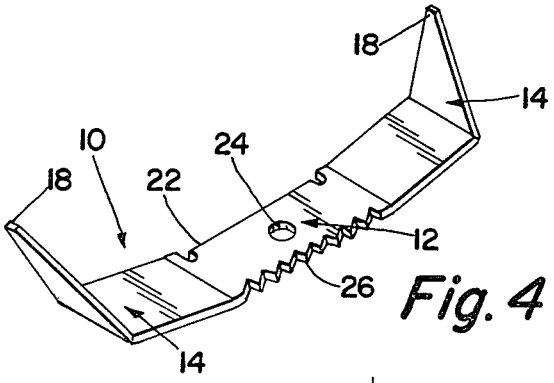
FIG. 4 is a perspective view of the preferred form of a clip shown in FIG. 1.
Figure 3:
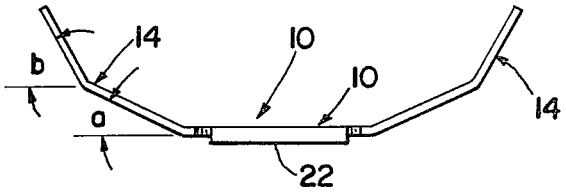
FIG. 3 is a side elevational view of the preferred form of a clip shown in FIG. 1.

FIGS. 1, 3, and 4 are top plan, side elevational, and perspective views, respectively, of the preferred form of a clip 10. The clip is made from a strip of resilient material, such as plastic, but preferably a strip of metal. Most preferred is cadium plated spring steel. The clips can be fabricated by stamping or otherwise cutting blanks from strip stock, and simultaneously or in sequence bending the blanks. The cutting operations mentioned below would in most instances be performed before or during the bending operation. The central web 12 of the resilient strip is preferably generally flat. Both ends 14 of the strip are deflected in the same direction away from the plane of the generally flat central web 12. This can most easily be done by simply bending each end of the flat strip of metal. Preferably, as best seen in FIG. 3, more than one set of bends are used to deflect the ends 14. It has been found that a suitable clip is made by having two bends in each end. The portion of end 14 proximate the central web 12 can satisfactorily be inclined at an angle "a" 19° from the plane of the central web, and the portion of end 14 distant from the central web can satisfactorily be inclined at an additional angle "b" of 41°, so that the latter end portion is deflected a total of 60° from the plane of the central web. FIG. 2 illustrates another embodiment of the clip 11 in which each end 16 is bent once.

In some embodiments of the clip each end of the strip has at least one tab 18. In the embodiments of the invention shown in the drawings, a single tab 18 is formed at each end by cutting off a portion of each end along a line inclined relative to the sides of the clip. The tabs are formed on the same side of the clip. In other embodiments (not shown) two tabs are readily formed on each end by cutting a semicircular notch in each end of the strip of metal before the ends are bent. Preferably, the tabs are not pointed but have flat or round ends to avoid gouging of the frame and of the picture and injury to the user.

For some embodiments of the clip a flange 22 is formed along one lateral edge of the central web of the clip. The flange extends out from the clip in a direction opposite the direction of deflection of the ends. In embodiments shown in the drawings, which have one tab on each end, the flange is formed on the same side as the tabs. This flange can be simply formed on a clip made from a piece of flat metal by making two cuts along the edge of the central web of the clip and then bending back the length of metal between the two cuts.

Particularly preferred embodiments of the clip include means for receiving hanger devices such as nails, hooks, wire, and the like. One such means is a hole 24 centered in the central web of the clip. Another such means is one or more serrations 26 in the second lateral edge of the central web opposite the flange 22.

As stated above, a clip according to this invention may have all or only some of these features. One preferred form of the clip combines all these features to yield a versitile clip capable of the several functions described below.

Figure 6:
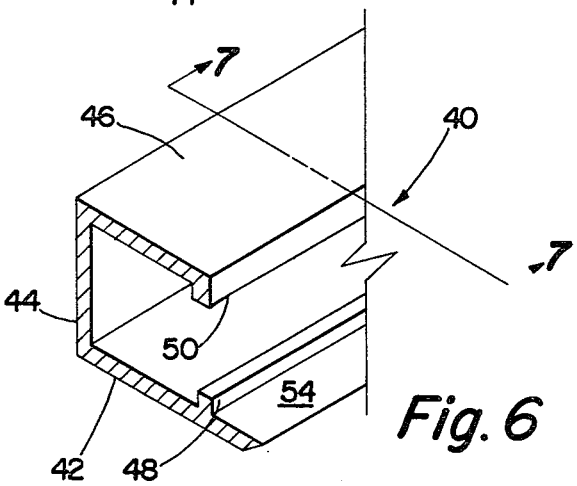
FIG. 6 is a perspective view of a frame section used to make a back-loading picture frame adapted for receiving a clip according to the invention.
Figure 7:
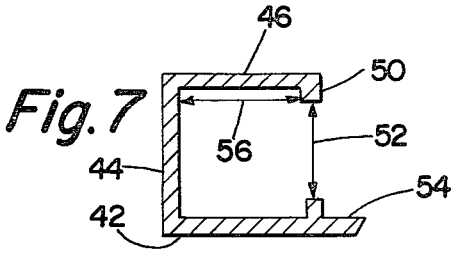
FIG. 7 is a cross-sectional view of a frame section taken along line 7—7 of FIG. 6.
Figure 5:
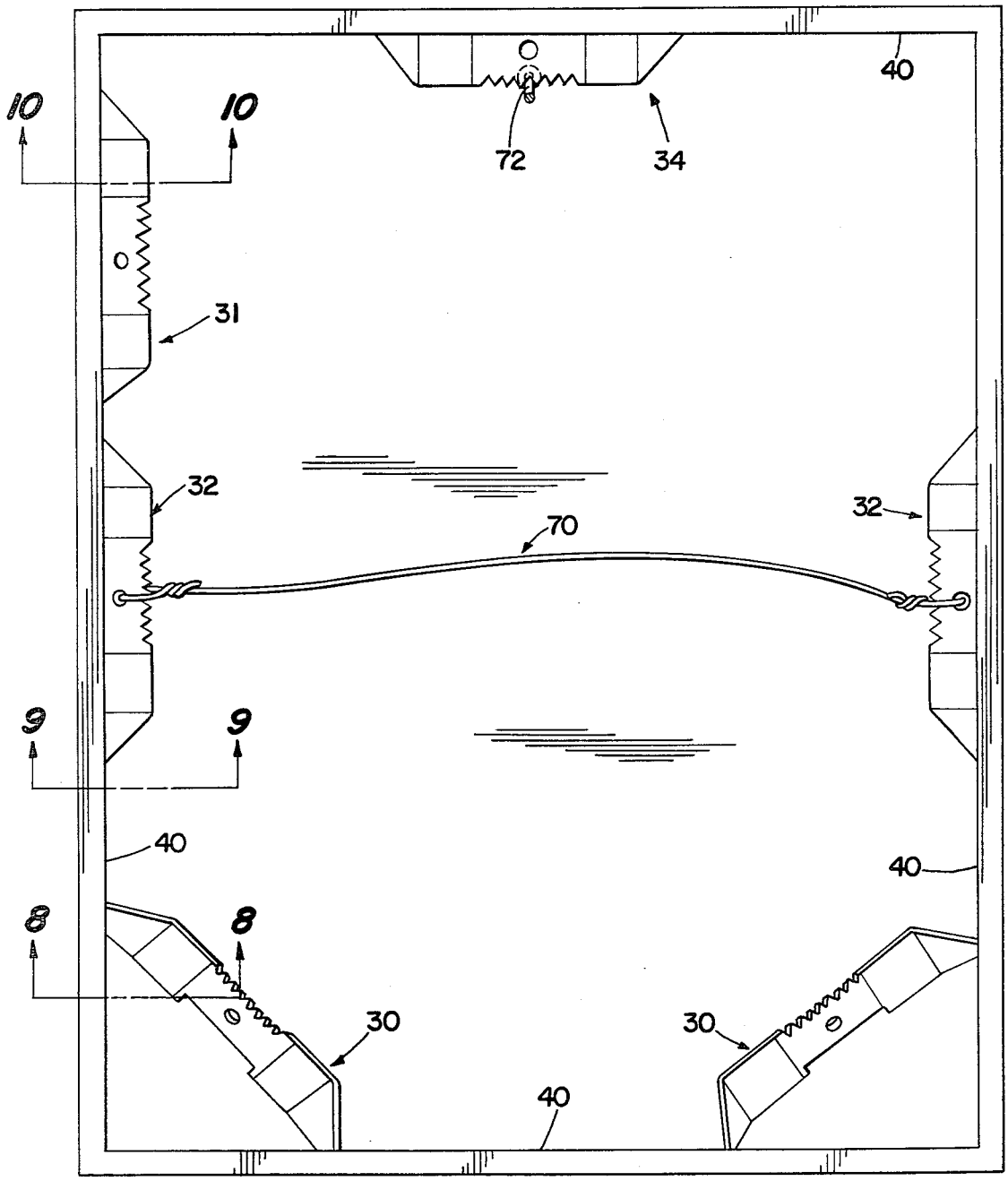
FIG. 5 is a rear view of a back-loading picture frame using clips according to the invention at the corners and the sides, including the top side of the frame, and illustrating the mounting of a wire and nail for hanging.

FIG. 5 is a rear view of a back-loading picture frame with the preferred form of the clips mounted at the corners 30, at the sides 31, 32, and also at the top side of the frame 34. Although back-loading frames may be adapted in other ways for use of clips according to the invention, a frame specially suited for the use of the clips is made from a plurality of frame sections 40. FIG. 6 is a perspective view of one frame section 40. FIG. 7 is a cross sectional view of the frame section along line 7—7 in FIG. 6. The frame sections may be made from a variety of materials, such as wood or plastic, but preferably they are metal such as extruded aluminum. The frame sections are preferably of the same construction, although their lengths might vary, but opposite sections would usually be of equal length. The frame sections are fastened to each other at the corners of the frame by means known in the art, such as by cooperating tongue and joint elements or adjoining sections or other mechanical connections, welding, adhesives, connecting elements such as clamps or staples, and the like.

Each frame section has a front member 42, side member 44, and back member 46. On the front member 42 there is formed a rearwardly raised ridge 48. On the rear member 46 there is formed a forwardly raised ridge 50. Although the two ridges may be formed opposite to each other, they are dimensioned so as not to touch, but rather there is a gap 52. The rearwardly raised ridge 48 on the front member 42 is offset from the edge of the front member opposite the side member so as to form a landing 54. The forwardly raised ridge 50 on the rear member 46 is offset from the side member so as to form a forwardly opening channel 56. Preferably the forwardly facing ridge 50 runs the length of the frame section, so that when four such sections are connected to form a rectangular frame, a continuous forwardly opening channel is defined.

Figure 8:
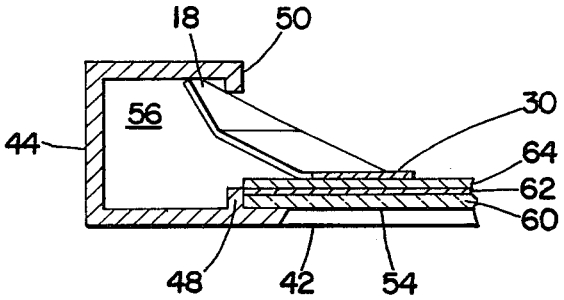
FIG. 8 is a cross-sectional view of a corner mounted clip taken along line 8—8 of FIG. 5.

FIG. 8 is a cross sectional view taken along line 8—8 in FIG. 5 and illustrates how the clip according to the invention is mounted at the corner of a back loading picture frame. A glass plate 60, the picture 62, and a protective backing 64 such as a cardboard sheet or the like are inserted into the picture frame from the rear. Optionally a picture mat may be placed between the picture and the glass plate. It should be understood that the plate and backing may be dispensed with, and the picture or other matter to be displayed may be inserted alone. The glass plate abuts the front member 42 of each of the frame sections along the landing 54 which serves to retain the plate in the frame by preventing it from coming out the front of the frame. The glass plate, picture, and backing abut the rearwardly raised ridge 48 on the front member of the frame section, which acts to center the picture in the frame in proper position for display. One or more of the retaining clips 30 are then inserted at the corners from the rear of the frame to hold the plate, picture, and backing in the frame. Preferably, a clip is used in each corner of the frame. In mounting a clip at a corner, a tab 18 on one end of the clip is inserted into the forwardly opening channel 56 in one section so that it engages against the forwardly raised ridge 50 on the back member of that frame section. The clip is pushed down so that the central web of the clip abuts the rear of the backing. Pressure is put on the other end of the clip and a tab on that end is similarly inserted into the forwardly opening channel of the adjacent frame section so that it engages against the forwardly raised ridge on the rear member of that frame section. The plate, picture, and backing are held in place in the frame since they are pressed between the clip and the forward member of each frame section. The ends of the clip are long enough and deflected at such an angle so that some pressure is required to fit the clip behind the picture and against the frame. Thus, the picture is resiliently held in the frame by the clip. Because the clip is made of resilient material it can be used to secure pictures of varying thicknesses. The clip may be formed from the frame by pressing down on one or both ends of the clip to disengage the tabs from the rear of the frame and then sliding the clip out. Alternatively, a flat tool may be inserted between the central web of the clip and the backing for loosening the clip.

When the clips are used only at the corners of the frame, the clips need not have the flange 22, hole 24, or serrations 26 in the central web shown in FIG. 1. However, the most versatile embodiment of the clip has these features as well. Indeed, if the clip is formed with a flange 22 along a lateral edge as described above, this flange will engage the backing 64 when the clip is used at the corners of the frame. This serves to more securely hold the clip in place since the flange slightly bites into the backing. Preferably the flange is formed without sharp edges and does not damage the backing.

Figure 9:
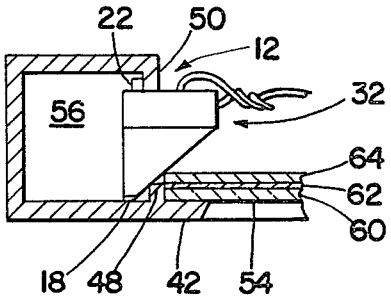
FIG. 9 is a cross-sectional view of a side mounted clip taken along line 9—9 of FIG. 5.

A clip with a flange 22 formed on the central web is suitable for use along the sides of a back-loading picture frame. FIG. 9 is a cross-sectional view taken along line 9—9 in FIG. 5 showing a clip 32 mounted along the side of a back-loading frame. A plate 60, a picture 62, and a backing 64, are inserted into the frame. They are prevented from coming out the front of the frame by the landing 54 on the forward member 42 of each frame section. They are centered in the frame by the rearwardly raised ridge 48 on the front member of each frame section. The clip 32 is inserted along the side of the frame and simultaneously pressed down and pushed sideways against the frame, so that the flange 22 on the clip is inserted into the forwardly opening channel 56 and engages against the forwardly raised ridge 50 on the back member of the frame section. A tab 18 on each end of the clip abuts the rearwardly formed ridge 48 on the front of the frame. A portion of the central web 12 of the clip abuts against the forwardly raised ridge 50 on the rear member of the frame section; however, there remains access to a substantial portion of the central web of the clip from the rear of the frame. The ends of the clip are long enough and deflected at such an angle so that some pressure is required to fit the clip behind the picture and against the frame. Thus, the picture is resiliently held in the frame by the clip. The clip may be removed by reversing the insertion process, that is by pressing down on the clip to disengage the flange and simultaneously pushing clip sideways to remove it from the rear of the frame.

Tabs 18 on the ends of the clip are not required when the clip is used only in the side mounted position on the rear of the frame and they may be dispensed with. However, the clip preferably has such tabs so that it may be used either at the corners or along the sides.

Additional modifications may be made in the clip so as to adapt it for use as a means for hanging the picture. A hole 24 in the clips of FIGS. 1 and 4, respectively, is put through the central web of the clip. Preferably, this hole is centered on the clip. The hole acts as a means for receiving a hanger device such as a nail, hook, wire, or the like. FIG. 5 shows how a pair of clips 32 are used to help hang a back-loading frame. A wire 70 is inserted between two clips 32 mounted on opposite sides of the picture frame. Since there is access to a substantial portion of the clip from the rear of the frame, when the clip is mounted along the side of the frame, the hole is readily accessible. Opposite ends of wire may be secured to the clips by inserting the wire into the hole 24 and wrapping the loose ends of the wires against the length of the wire. The wire is then used to hang the frame from a hook in the wall.

The clip may also be used to hang the frame from a nail or hook mounted on the wall. The nail or hook may be inserted into the hole 24 in the clip. Preferably, instead of using a hole in the clip, one or more serrations 26 in the central web of the clip along the lateral edge opposite the flange 22 are used to receive the nail. FIG. 5 shows a clip 34 mounted at the top side of a back-loading frame so that the serrations 26 engage the shank of a nail 72. The serrations are accessible because that portion of the clip is not obscured even when the clip is mounted along the top side of the frame. Thus, these notches act as a means for receiving a hanger device such as a hook, nail, or the like. The plurality of serrations enables the frame to be centered when hung so as to eliminate tilting.

Figure 10:
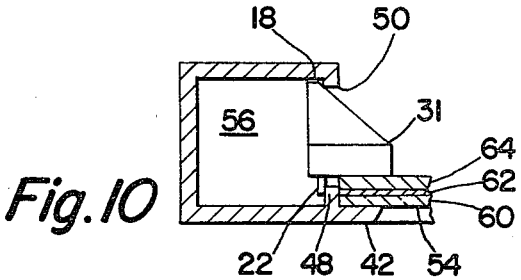
FIG. 10 is a cross-sectional view of a side mounted clip taken along line 10—10 of FIG. 5.

FIG. 10 is a cross-sectional view taken along line 10—10 in FIG. 5 showing a clip 31 mounted the side of a back-loading frame. This manner of mounting the clip is upside down from the manner shown at 32 in FIGS. 5 and 9. A glass plate 60, picture 63, and protective backing 64 or the like are inserted as described above. One or more of the clips are then inserted along the side of the rear of the frame, perhaps as a supplement to other clips mounted at the corners or along the sides when the frame is rather large or even instead of using clips mounted in another manner. In mounting a clip 31 along the side of the frame, tabs 18 on each end of the clip are inserted into the forwardly opening channel 56 in one section of the frame so that they engage against the forwardly raised ridge 50 on the back member of that frame section. The clip may then be pushed down and against the frame so that the central web of the clip abuts the rear of the backing. If the embodiment of the clip used is one with a flange 22, the clip 31 is mounted so that the flange 22 abuts the rearwardly formed ridge 48 on the front of the frame section. This may be accomplished by first aligning the flange 22 and then pressing down on the ends of the clip and inserting the tabs 18 into the forwardly opening channel 56. Although a flange 22 is not necessary, it has the advantage of more securely attaching the clip to the frame. Whether or not a flange 22 is used on the clip 31, the plate, picture and backing are held in place in the frame by being pressed between the central web of the clip and the landing 54 on the forward member on the frame section. The picture is resiliently held in the frame because the ends of the clip are long enough and deflected at such an angle so that some pressure is required to fit the clip behind the picture and against the frame.

The preferred embodiment described herein fulfills the objects of the invention. A clip for retaining pictures in a back-loading picture frame has been disclosed. The clip may be mounted from the rear of the frame either along the side or at the corner of the frame. When mounted along the side the clip can also serve as a means for hanging the frame.

The invention has been described with particular reference to the preferred embodiments, but it will be understood that variations and modifications within the spirit and scope of the invention may occur to those skilled in the art to which the invention pertains.

What we claim is:

1. A clip for retaining pictures in back-loading picture frames, comprising:

a resilient strip including a central web intermediate opposite ends, both said ends being deflected in the same direction from the plane of said central web, said central web having a first lateral edge and a second lateral edge; and a flange along said first lateral edge extending from said central web in a direction generally opposite the deflection of said ends, wherein said strip may be positioned with said flange engaging the rear of the back-loading picture frame and the picture being retained between the front of the back-loading picture frame and said ends.

2. A clip for retaining pictures in back-loading picture frames, comprising:

a resilient strip including a central web intermediate opposite ends, both said ends being deflected in the same direction from the plane of said central web, said central web having a first lateral edge and a second lateral edge;

a flange along said first lateral edge extending from said central web in a direction generally opposite the deflection of said ends; and at least one tab formed on each said end, wherein said strip may be selectively positioned either with said tabs engaging the rear of the picture frame and the picture being retained between the front of the frame and said central web, or with said flange engaging the rear of the picture frame and the picture being retained between the front of the frame and said ends.

3. A picture frame retaining clip as claimed in claims 1 or 2, further comprising:

means for receiving a hanger device.

4. A picture frame retaining clip as claimed in claims 1 or 2, further comprising:

a hole in said central web for reception of a hanger device.

5. A picture frame retaining clip as claimed in claims 1 or 2, wherein said second lateral edge is serrated for reception of a hanger device.

6. A picture frame retaining clip as claimed in claims 1 or 2, further comprising:

a hole in said central web for reception of a hanger device; and said second lateral edge is serrated for reception of a hanger device.

7. A picture retaining clip for use with a back-loading picture frame which has along its rear a forwardly raised ridge, comprising:

a resilient strip including a central web intermediate opposite ends, both said ends being deflected in the same direction from the plane of said central web, said central web having a first lateral edge and a second lateral edge; and a flange along said first lateral edge for engaging the ridge along the rear of the frame, said flange extending from said central web in a direction generally opposite the deflection of said ends, wherein said strip may be positioned to retain the picture between the front of the frame and said ends.

8. A picture retaining clip for use with a back-loading picture frame which has along its rear portion a forwardly raised ridge and along its front portion a rearwardly raised ridge, said clip comprising:

a resilient strip including a central web intermediate opposite ends, both said ends being deflected in the same direction the plane of said central web, said central web having a lateral edge;

at least one tab formed on each said end for engaging the forwardly raised ridge on the frame; and a flange along said lateral edge for engaging the rearwardly raised ridge on the frame, wherein said strip may be positioned to retain the picture between the front of the frame and said central web.

9. A picture retaining clip for use with a back-loading picture frame which has along its rear a forwardly raised ridge and along its front a rearwardly raised ridge, comprising:

a resilient strip including a central web intermediate opposite ends, both said ends being deflected in the same direction from the plane of said central web, said central web having a first lateral edge and a second lateral edge;

at least one tab formed on each said end, said tabs being adapted to alternately engage the forwardly raised ridge on the frame and the rearwardly raised ridge on the frame; and a flange along said first lateral edge adapted to engage the forwardly raised ridge on the frame when said tabs engage the rearwardly raised ridge, wherein said strip may be selectively positioned either to retain the picture between the front of the frame and said central web when said tabs engage the forwardly raised ridge or to retain the picture between the front of the frame and said ends when said flange engages the forwardly raised ridge.

10. The picture retaining clip of claim 9, wherein said flange is adapted to engage the rearwardly raised ridge on the frame when said tabs engage the forwardly raised ridge on the frame.

11. A picture frame retaining clip, as claimed in claims 7, 9, or 10 further comprising:

a means for receiving a hanger device.

12. A picture frame retaining clip, as claimed in claims 7, 9, or 10 further comprising:

a hole in said central web for reception of a hanger device.

13. A picture frame retaining clip, as claimed in claims 7, 9, or 10 wherein said second lateral edge is serrated for reception of a hanger device.

14. A picture frame retaining clip, as claimed in claims 7, 9, or 10 further comprising:

a hole in said central web for reception of a hanger device, and wherein said second lateral edge is serrated for reception of a hanger device.

* * * * *